United States Patent [19]

Wilson

[11] 4,180,875

[45] Jan. 1, 1980

[54] URINE DISPOSAL BYPASS UNIT

[76] Inventor: Porter C. Wilson, P.O. Box 11010, Tucson, Ariz. 85734

[21] Appl. No.: 906,415

[22] Filed: May 16, 1978

[51] Int. Cl.[2] ..... E03D 13/00; E03D 11/02; E03D 9/02

[52] U.S. Cl. ..... 4/309; 4/197; 4/224; 4/311; 4/426; 4/434

[58] Field of Search ..... 4/300, 301, 1, 306, 4/307, 309, 311, 340–342, 348, 350, 351, 420, 434, 441, 113.1, 114.1, 144.1, 144.3, 258, 261–264, 276, 283, DIG. 2, 115, 222, 197, 224, 426; 137/247.15, 218, 247.13, 247.17, 247.19; 128/295

[56] References Cited

U.S. PATENT DOCUMENTS

| | | | |
|---|---|---|---|
| 1,137,516 | 4/1915 | Moon | 137/247.15 |
| 1,239,319 | 9/1917 | Vampa | 4/434 |
| 2,754,145 | 7/1956 | Mackey | 4/262 X |
| 3,295,148 | 1/1967 | Deeley | 4/263 |
| 3,384,907 | 5/1968 | Lappin et al. | 4/264 |
| 3,500,480 | 3/1970 | Michal, Jr. | 4/301 |
| 3,530,513 | 9/1970 | Maurer et al. | 4/1 X |
| 3,557,388 | 1/1971 | Bach | 4/115 X |
| 3,735,428 | 5/1973 | Olivero | 4/311 X |
| 3,964,110 | 6/1976 | Kapit | 4/301 X |
| 3,992,727 | 11/1976 | Elkins | 4/115 X |
| 4,137,579 | 2/1979 | Soler | 128/295 |

FOREIGN PATENT DOCUMENTS

| | | | |
|---|---|---|---|
| 681009 | 1/1930 | France | 4/262 |
| 23129 | of 1901 | United Kingdom | 4/262 |

*Primary Examiner*—Stuart S. Levy
*Attorney, Agent, or Firm*—Millen & White

[57] ABSTRACT

A urine disposal bypass unit includes a bowl for receiving urine having a bottom outlet for disposing of the urine, a one-way valve disposed in the outlet to permit flow from the bowl downward through the outlet and to prevent flow of gases upward into the bowl, a flush valve mounted on the bowl for supplying flushing liquid to a spray assembly mounted on the bowl at a position to supply the flushing liquid around the bowl to flush the bowl, a flexible drain hose coupled with the outlet of the bowl to provide communication between the bowl and a main drain, a flexible supply hose coupled with the flush valve to supply flushing liquid thereto, an extensible arm assembly mounted on a stationary support and carrying the bowl in order to permit the bowl to be extended from a storage position adjacent the stationary support and a check valve in the bowl base for passing urine and flushing liquid therethrough and maintaining a predetermined volume of liquid thereabove to act as a trap. The urine disposal bypass unit permits the flushing of urine while bypassing the toilet and requiring only one cup of flushing liquid.

15 Claims, 9 Drawing Figures

URINE DISPOSAL BYPASS UNIT

BACKGROUND OF THE INVENTION

1. Field of the Invention

The present invention pertains to the disposal of body waste materials and, more particularly, to a urine disposal unit bypassing the normally utilized toilet.

2. Discussion of the Prior Art

As is well known, the use of toilets represents a great waste of water in that flushing of toilets normally uses from 5 to 7 gallons of water which has been purified to be potable and could be put to many other uses. The average household use of water per day has been determined to be 200 gallons per person and 38% of this water is utilized to flush away urine. This represents a substantial waste of fresh processed water as well as a waste of the energy required to lift, purify, store and distribute the water. Additionally, flushing of urine wastes energy and money due to the processing of the more than 50 gallons of liquid sewerage created per person per day. While attempts have been made to modify toilets to reduce the water required for flushing, such attempts have not been entirely successful in that a great amount of water is still required to cause the water in the toilet bowl to pass the trap in the body of the toilet. The use of toilets is required for flushing solid waste; however, this still represents a substantial waste of water and energy for flushing urine and liquid waste to a drain.

SUMMARY OF THE INVENTION

Accordingly, it is a primary object of the present invention to overcome the above mentioned disadvantages of the prior art by providing a unit for disposing of urine bypassing the toilet.

Another object of the present invention is to position a urine disposal bypass unit adjacent a toilet or basin connected with a main drain to permit urine received in the unit to be flushed to the main drain via drain passages or pipes of a toilet or basin without having to be flushed through the toilet.

An additional object of the present invention is to mount a flush valve on a bowl of a urine disposal bypass unit to permit only a minimal quantity of flushing liquid to be sprayed on the bowl to flush urine from the bowl and associated hoses into a main drain.

The present invention has another object in that a small water reservoir is disposed directly below the bowl of a urine disposal bypass unit to act in combination with a one-way valve in an outlet of the bowl as a double fail-safe system to assure that no urine or odor or noxious gases can pass upward through the bowl.

A further object of the present invention is to provide a urine disposal bypass unit mounted on a movable support in a lavatory to be easily used for bypassing the toilet in disposing of urine thereby using only a small quantity of flushing liquid, on the order of one cup.

Some of the advantages of the present invention over the prior art are that the amount of flushing liquid required to dispose of urine is reduced to a minimum, the urine disposal bypass unit can be inexpensively manufactured and installed, and the urine disposal bypass unit is completely sanitary to permit coupling with the drain pipes and passages of various plumbing appliances.

The present invention is generally characterized in a urine disposal bypass unit including a bowl having a top peripheral edge defining an opening for receiving urine and a bottom outlet for disposal of the urine, a one-way valve and water trap disposed in the outlet to permit downward flow of urine therethrough and prevent gases from flowing upward therethrough into the bowl, a drain conduit having a first end coupled with the outlet of the bowl and a second end adapted to be coupled with a main drain, a spray assembly mounted on the bowl to supply flushing liquid to the bowl, a flush valve mounted on the bowl to supply flushing liquid to the spray assembly.

Other objects and advantages of the present invention will become apparent from the following description of the preferred embodiment taken in conjunction with the accompanying drawings.

DESCRIPTION OF THE PREFERRED EMBODIMENT

Figure 1:
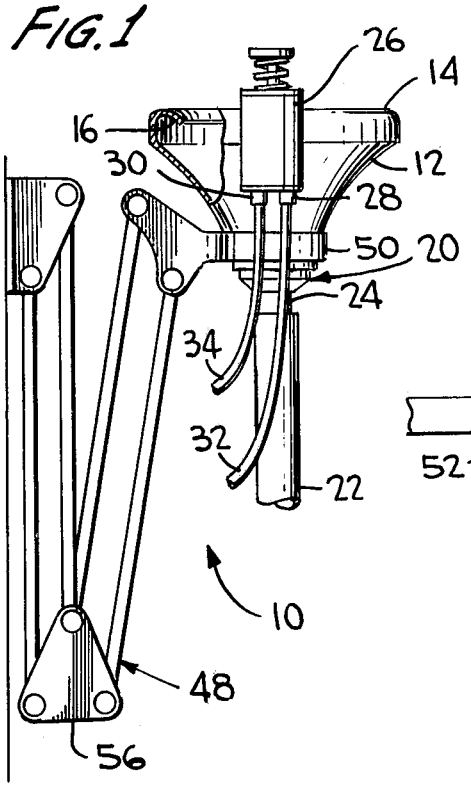
FIG. 1 is a broken side elevation of a urine disposal bypass unit according to the present invention in a storage position.
Figure 3:
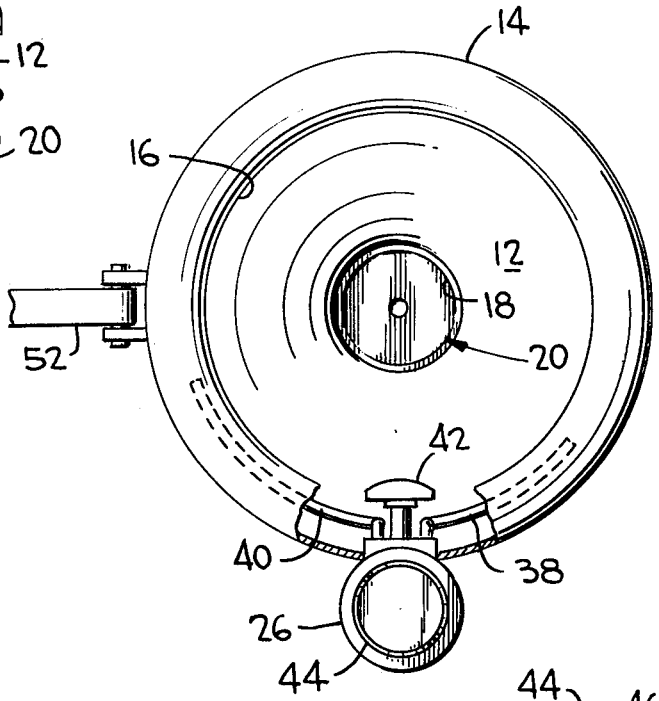
FIG. 3 is a broken top plan view of the urine disposal bypass unit of FIG. 1.
Figure 2:
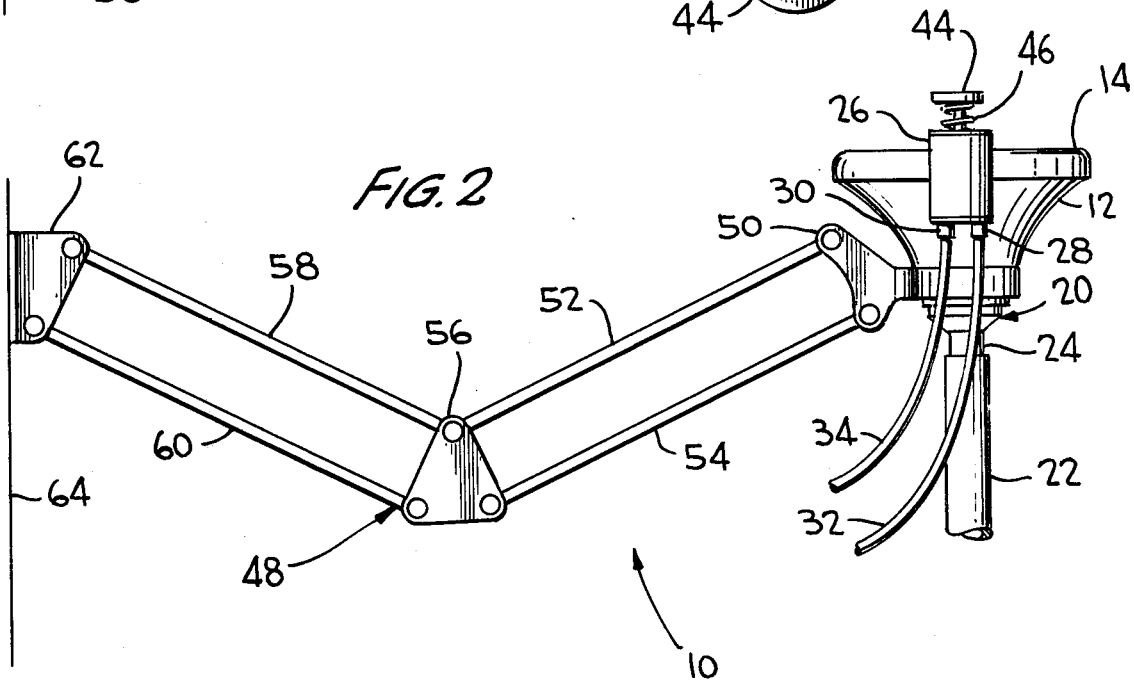
FIG. 2 is a side elevation of the urine disposal bypass unit of FIG. 1 in an extended position.

A urine disposal bypass unit 10 according to the present invention, as shown in FIGS. 1, 2 and 3, includes a bowl 12 having a top peripheral edge 14 formed by an inwardly, radially extending, downwardly curved lip 16 defining an opening for reciving urine and a bottom outlet 18 for disposing of the urine having a one-way flap-type valve 20 therein to prevent noxious gases and odors from passing upward through the bowl. A drain conduit for the bowl includes a flexible drain hose 22 having one end coupled with a nipple 24 extending from a housing 25 communicating with the outlet 18, the other end of the conduit adapted to be coupled with a main drain leading to a sewer system.

A flush valve 26 is mounted on the peripheral edge 14 of the bowl 12 and has inlets 28 and 30 coupled with flexible hoses 32 and 34, respectively, for supplying flushing liquids to the flush valve 26. For example, water can be supplied through hose 32 from a main water supply pipe while a disinfectant and/or deodorizer liquid can be supplied through hose 34 from a suitable container with the inlet 30 coupled with the valve in a manner to permit the water to entrain the disinfectant and/or deodorizer liquid by aspiration. The flush valve 26 has an outlet communicating with a spray assembly formed of oppositely extending curved spray arms 38 and 40 positioned within the curved lip 16 each having downwardly directed apertures therealong and a spray head 42 projecting into the bowl 12 for directing a spray of flushing liquid centrally into the bowl. An actuator 44 extends from the flush valve 26 and controls the flush valve such that, when the actuator is depressed against the force of a coiled spring 46, the outlet communicates with the inlets to supply flushing liquid to the spray assembly.

The bowl 12 is mounted on a movable support such as an extendable folding arm assembly 48 via a bracket 50 pivotally mounting a pair of parallel arms 52 and 54 which are pivotally mounted at their opposite ends on a plate 56. A pair of parallel arms 58 and 60 are pivotally mounted on plate 56 and pivotally extend from a mounting bracket 62 which is mounted on a stationary support 64, such as a wall or a free standing floor rack, to be pivotal about a vertical axis.

Figure 4:
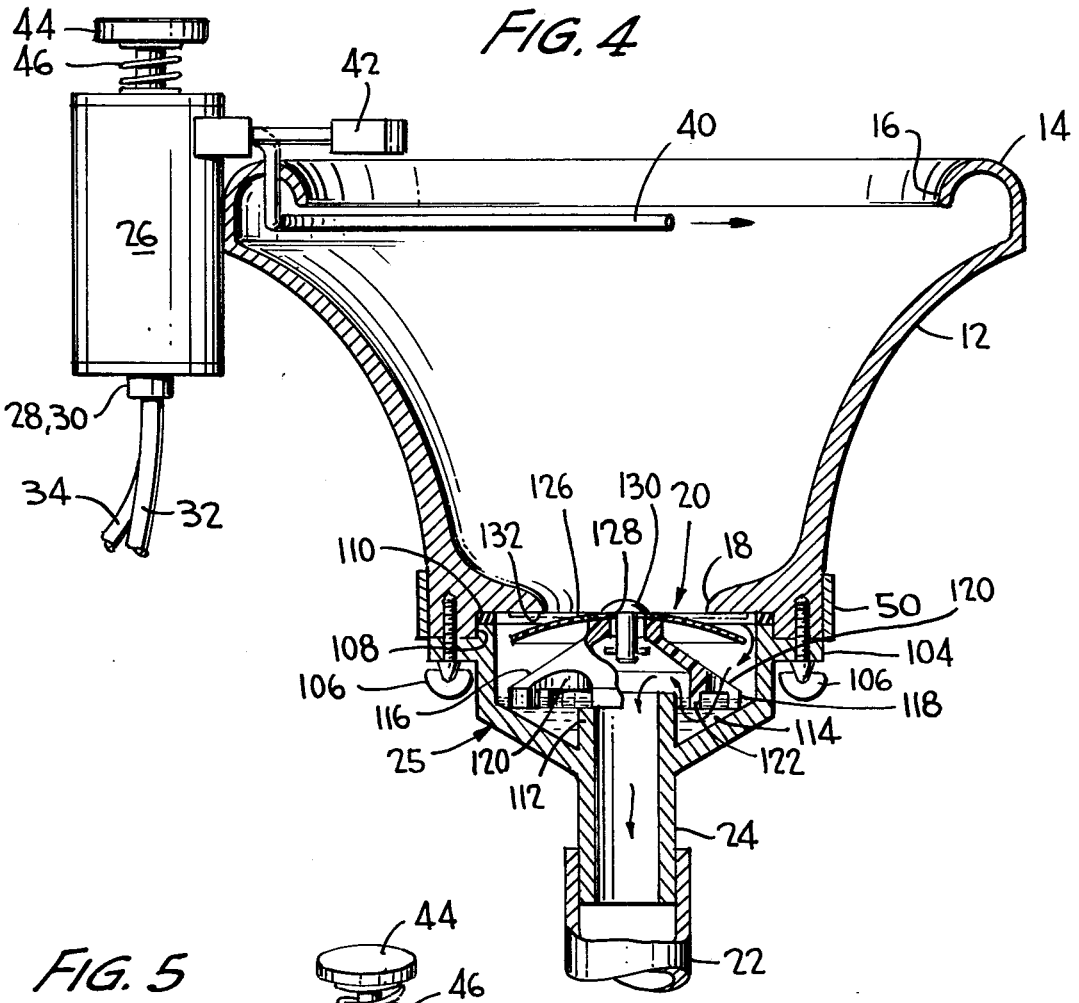
FIG. 4 is a vertical section of the bowl and one-way valve of the urine disposal bypass unit of FIG. 1.
Figure 5:
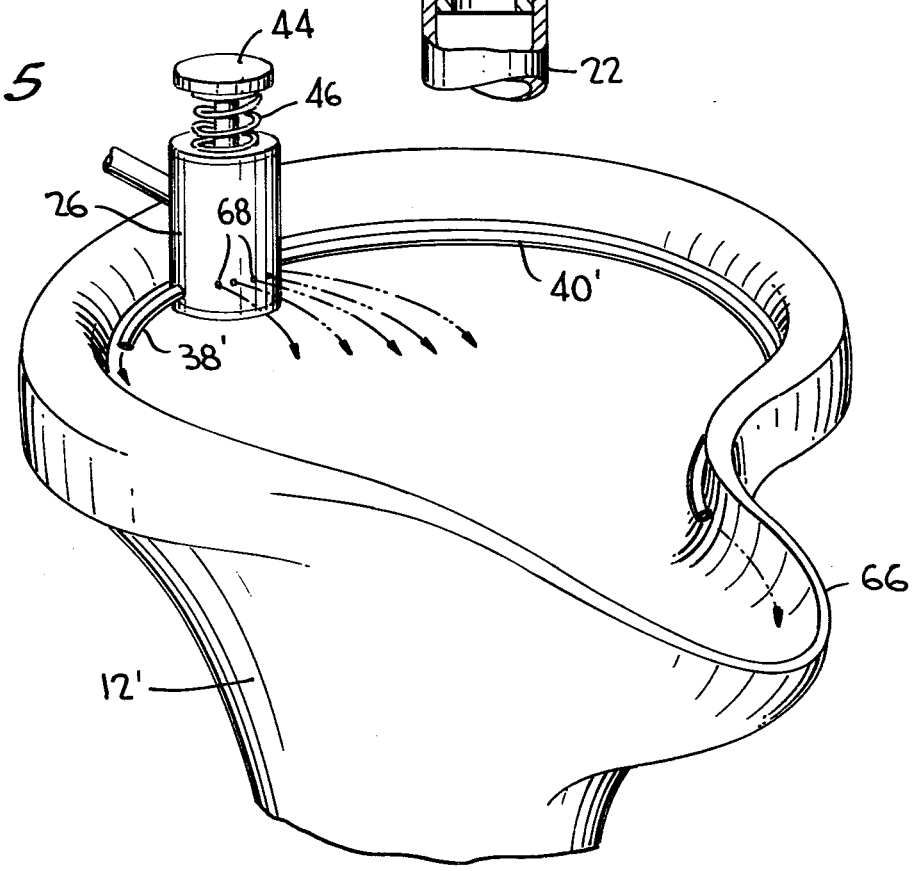
FIG. 5 is a broken perspective view of a modified bowl configuration for use with the urine disposal bypass unit of the present invention.

The bowl 12 can have a round configuration, as shown in FIG. 4, for use primarily by males or a configuration having an extending trough 66 projecting from a partly round bowl 12', as shown in FIG. 5 for use by both males and females. In the bowl 12', the valve 26 has apertures 68 in the housing therefor to provide a central spray into the bowl, and spray arms 38' and 40' extend around the periphery of the bowl to spray flushing liquid on the trough 66.

Figure 6:
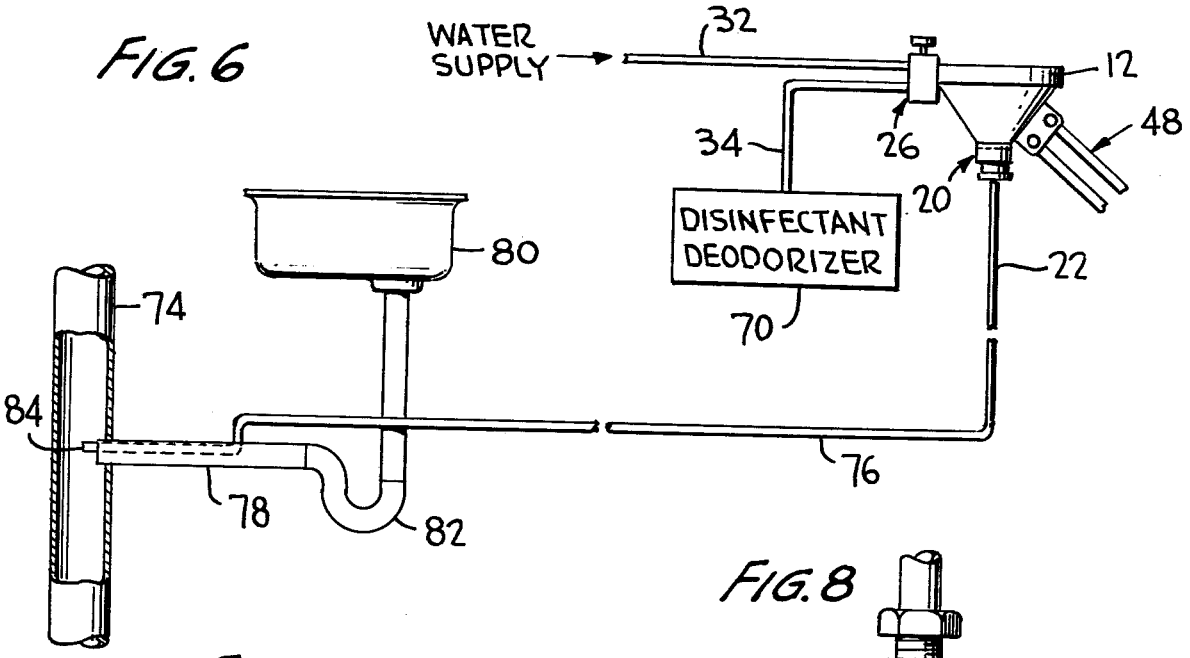
FIG. 6 is a schematic diagram of the urine disposal bypass unit of the present invention used with a basin.

A system using the urine disposal bypass unit 10 of the present invention is illustrated schematically in FIG. 6 wherein the flush valve 26 is shown as receiving water through hose 32 from a household water supply pipe and a deodorizer and/or disinfectant liquid through hose 34 from a container 70 of a size to rest unobtrusively on the floor of a lavatory. The drain hose 22 communicates with a sewer downlet pipe 74 via a rigid or flexible tubing 76, it being noted that the drain conduit from the urine disposal bypass unit 10 need be flexible only along a length sufficient to permit movement of the unit by means of extendable arm assembly 48. The tubing 76 joins a drain pipe 78 from a basin 80 at a point downstream of a trap 82, the tubing extending through the basin drain pipe to permit flow from the urine disposal bypass unit 10 to pass directly into the sewer downlet pipe 74 to permit no mixing within the basin drain pipe. The tubing 76 extends along the top unused portion of the basin drain pipe 78 and terminates at an end 84 extending beyond the end of the basin drain pipe within the sewer downlet pipe such that the water barrier in the trap 82 prevents gases and odor from entering the lavatory via the basin 80.

Figure 8:
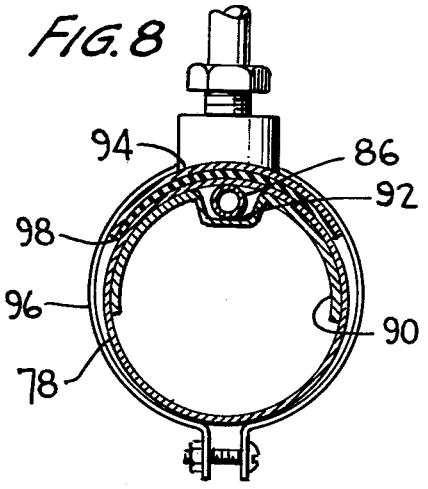
FIG. 8 is a section taken along line 8—8 of FIG. 7.
Figure 7:
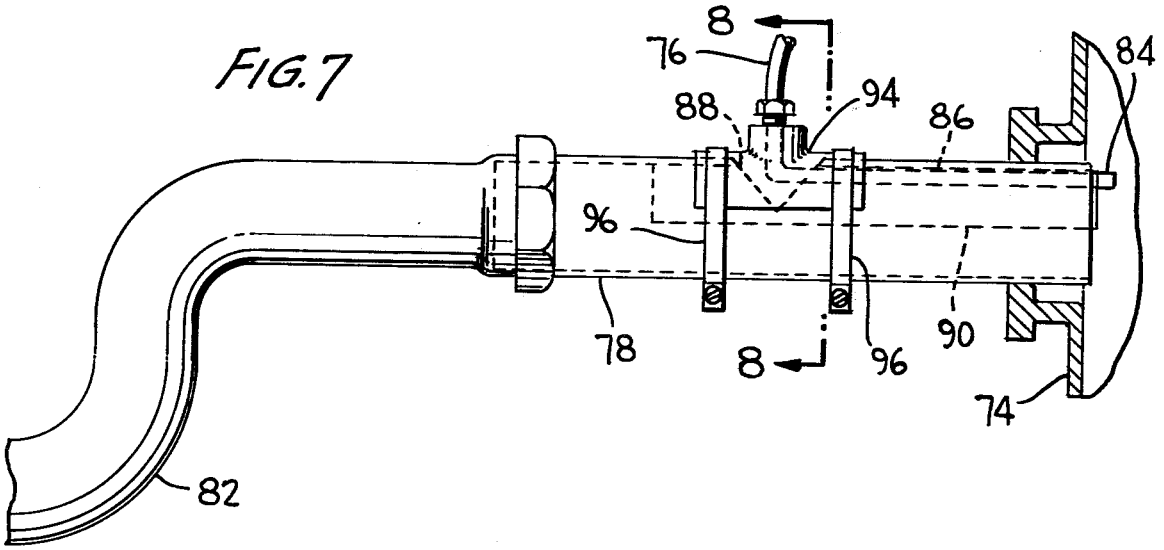
FIG. 7 is a broken side elevation of the coupling of the drain conduit from the urine disposal bypass unit of the present invention with the drain pipe from the basin of FIG. 6.

The connection of the tubing 76 with the basin drain pipe 78 is shown in more detail in FIGS. 7 and 8, the tubing 76 being bent to form a leg 86 extending within the basin drain pipe 78. The basin drain pipe is notched at 88 to permit insertion of the tubing 76 and a semicylindrical support sleeve 90 having a recess 92 therein for receiving the tubing leg 86 and holding the tubing leg in the top portion of the basin drain pipe. The tubing extends through a saddle 94 which is mounted on the basic drain pipe by spaced clamps 96 to sandwich a rubber sealing gasket 98 between the basin drain pipe and the saddle.

Figure 9:
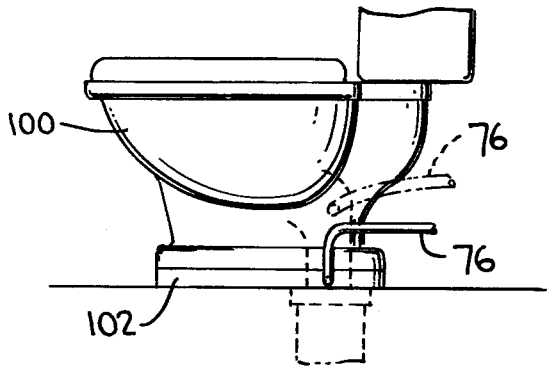
FIG. 9 is a broken side elevation of a toilet coupled with the drain conduit from the urine disposal bypass unit of the present invention.

Of course, the drain conduit from the urine disposal bypass unit 10 can be coupled with the drain pipe from any suitable household plumbing appliance; and, to this end, the drain tubing 76 is shown in FIG. 9 coupled with a toilet 100 by means of a plate 102 having an inlet connection therein communicating with the drain passage from the toilet, the toilet being mounted on the plate 102 in sealed relation therewith such that both the toilet 100 and the urine disposal bypass unit 10 drain into a main sewer pipe. Alternatively, the drain tubing 76 can communicate with the internal plumbing of the toilet by drilling through the porcelain body thereof as shown in dashed lines in FIG. 9, or toilets can be manufactured to have a bypass inlet connector positioned just below the "P" trap therein.

The one-way valve 20 is best shown in FIG. 4 and includes housing 25 which has an angled bottom wall terminating at a cylindrical wall from which externally extends a flange 104, and wing bolts 106 pass through the flange 104 to secure the housing 25 to the bottom of bowl 12 with the upper end of the cylindrical wall of the housing received in a cylindrical recess 108 to compress a rubber O-ring seal 110. The nipple 24 has an internally extending portion 112 that defines with the bottom wall of the housing 25 a liquid trap 114, and a mounting member 116 has a peripheral bottom edge 118 resting on the bottom wall of the housing. The mounting member 116 has a generally conical configuration with openings 120 in the outer edge thereof, a depending wall 122 concentrically spaced within the peripheral edge 118, and a central recess 124 accommodating the internal portion 112 of nipple 24. A resilient plastic flap valve member 126 is mounted on the top of mounting member 116 and has a central aperture aligned with a hole 128 in the top of the mounting member, and an air bleed button 130 has an enlarged head covering the aperture in flap valve member 126 and a stem extending through hole 128 such that the air bleed button is longitudinally movable relative to the mounting member and the flap valve member. The flap valve member 126 normally engages a valve seat 132 formed by recess 108 at outlet 18, as shown in dashed lines in FIG. 4, and resiliently flexes to permit flow of liquid downward therearound.

To use the urine disposal bypass unit 10 after installation with a basin or toilet drain in the manner shown in FIGS. 6, 7 and 8 or 9, the user pulls the unit from the storage position, shown in FIG. 1, to place the unit in an extended position via the folding arm assembly 48 to accommodate the user according to height and sex, and the bowl 12 will remain in the extended position, as shown in FIG. 2, without being held by the user due to friction on the pivotal connections of the arms 52, 54, 58 and 60. The user now urinates in the bowl 12 with the urine flowing silently and instantly through the one-way valve 20 at the outlet 18 due to flexing of the flap valve member 126 under the weight of the urine. The urine passes around the flap valve member and through openings 120 and the liquid trap into the drain hose 22, the one-way valve 20 preventing any escape of noxious gases and odor from the urine upward into the lavatory due to the flap valve member normally engaging valve seat 132. The actuator 44 is depressed to open flush valve 26 while the unit is returned to the storage position to pass a maximum of one cup of flushing liquid to the spray arms 38 and 40 and the spray head 42 to wash the bowl 12 and flush the urine from the drain hose 22 into the sewer downlet 74 via tubing 76. A small volume of flushing liquid is retained below the bowl 12 in trap 114 to assure that no urine or gases can escape upward through the bowl. The liquid trap in the one-way valve also instantly stops liquid from backing up into the bowl when the bowl is lowered to a position near the floor, for example, when the urine disposal bypass unit 10 is being used by a small child. The air bleed button 130 prevents air lock if liquid is standing in a loop in the flexible drain hose.

From the above, it will be appreciated that the flushing action of a toilet normally required to dispose of urine is obviated by the urine disposal bypass unit 10 since the unit can be flushed to cause the urine and the flushing liquid to bypass the toilet. Accordingly, the five to seven gallons of water normally used to flush a toilet are saved with only one cup of water utilized in place thereof. Preferably, the deodorizer/disinfectant liquid would include an anti-mold inhibitant and be fast evaporating while containing a fragrance such that the spray head causes the entire lavatory to be deodorized each time the unit is flushed. The spray from the spray head also can be used for sanitizing the user's fingers while the unit is being flushed.

Inasmuch as the present invention is subject to many variations, modifications and changes in detail, it is intended that all subject matter discussed above or shown in the accompanying drawings be interpreted as illustrative and not in a limiting sense.

What is claimed is:

1. A urine disposal bypass unit comprising a bowl having a top peripheral edge defining an opening for receiving urine and a bottom outlet for disposing of the urine and presenting an annular valve seat;

a valve housing at the outlet side of the valve seat;

one-way valve means disposed at said outlet of said bowl and including a normally biased closed valve plate within the housing for selective opening and closing movements relative to said valve seat and movable under influence of liquid thereon for selective relative cooperation with said valve seat in open position to permit downward flow of urine therethrough and in closed position to prevent gases from flowing upward therethrough into said bowl, said one-way valve means including a support member within the housing mounting the valve plate and cooperating with the housing in defining a liquid trap for maintaing a predetermined volume of liquid below said outlet; said valve plate comprises a disk member centrally mounted on said support member and normally biased to seated closed position on the valve seat;

drain conduit means having a first end coupled with said one-way valve means to receive liquid from said outlet of said bowl and a second end adapted to be coupled with a main drain; spray means mounted on said bowl to supply flushing liquid to said bowl; and flush valve means mounted on said bowl to supply flushing liquid to said spray means whereby the flushing liquid is maintained in said liquid trap in said one-way valve means.

2. A urine disposal bypass unit as recited in claim 1 and further comprising movable support means mounting said bowl.

3. A urine disposal bypass unit as recited in claim 2 wherein said movable support means includes an extendable arm assembly having a first end mounted on a stationary support and a second end supporting said bowl.

4. A urine disposal bypass unit as recited in claim 1 wherein said spray means includes a spray head discharging flushing liquid toward the center of said bowl.

5. A urine disposal bypass unit as recited in claim 4 wherein said spray means includes spray arms extending along said peripheral edge of said bowl and said peripheral edge has a downwardly turned lip encompassing said spray arms.

6. A urine disposal bypass unit as recited in claim 5 wherein the flushing liquid includes water and a deodorizer and disinfectant liquid.

7. A urine disposal bypass unit as recited in claim 6 and further comprising a container of said deodorizer and disinfectant liquid and a supply hose coupling said container with said flush valve means and wherein said flush valve means and wherein said flush valve means includes aspirating means for entraining said deodorizer and disinfectant liquid in said water.

8. A urine disposal bypass unit as recited in claim 1 wherein said urine disposal bypass unit is utilized with a basin having a drain pipe coupled with a vertical main drain and said drain conduit means includes a tubing having a portion within an upper portion of said drain pipe to protrude into said vertical main drain.

9. A urine disposal bypass unit as recited in claim 1 wherein said urine disposal bypass unit is utilized with a toilet having a drain passage therein and said drain conduit means includes a tubing coupled with said drain passage in said toilet.

10. A urine disposal bypass unit as recited in claim 1 wherein said bowl has a trough extending therefrom.

11. A urine disposal bypass unit as recited in claim 1 wherein said one-way valve means further comprises a resilient flap valve member.

12. A urine disposal bypass unit as recited in claim 1 wherein said valve plate comprises a resilient disk member.

13. A urine disposal bypass unit as recited in claim 1 wherein said support member includes openings therethrough to direct liquid to the liquid trap as it is peripherally discharged from the valve disk in open position relative to the valve seat.

14. A urine disposal bypass unit comprising a bowl having a top peripheral edge defining an opening for receiving urine and a bottom outlet for disposing of the urine;

one-way valve means disposed at said outlet of said bowl and to permit downward flow of urine therethrough and prevent gases from flowing upward therethrough into said bowl, said one-way valve means including a housing defining a liquid trap for maintaining a predetermined volume of liquid below said outlet, and further including a valve seat and a resilient flap valve member normally engaging said valve seat and flexing under the weight of liquid thereon to pass urine and flushing liquid; and said one-way valve means includes a mounting member disposed in said housing having a bottom peripheral edge with openings therein to form a passage for urine and flushing liquid to flow to said trap and a top portion carrying said resilient flap valve member, drain conduit means having a first end coupled with said one-way valve means to receive liquid from said outlet of said bowl and a second end adapted to be coupled with a main drain; spray means mounted on said bowl to supply flushing liquid to said bowl; and flush valve means mounted on said bowl to supply flushing liquid to said spray means whereby the flushing liquid is maintained in said liquid trap in said one-way valve means.

15. A urine disposal bypass unit as recited in claim 14 wherein said top portion of said mounting member has a hole extending vertically therethrough and said resilient flap valve member has an aperture therein aligned with said hole and further comprising an air bleed button having a head covering said aperture in said resilient flap valve member and a stem extending through said hole in said mounting member, said button being longitudinally movable to prevent air lock from liquid standing in said drain conduit means.

* * * * *